US006056914A

United States Patent [19]

Van Dril

[11] Patent Number: 6,056,914

[45] Date of Patent: May 2, 2000

[54] APPARATUS FOR CHARGING A SHAFT-TYPE CUPOLA FURNACE

[76] Inventor: William A. Van Dril, 4167 Gloucester Dr., Allegan, Mich. 49010

[21] Appl. No.: 09/267,144

[22] Filed: Mar. 11, 1999

Related U.S. Application Data

[60] Provisional application No. 60/077,773, Mar. 11, 1998.

[51] Int. Cl.[7] ..... C21B 7/08

[52] U.S. Cl. ..... 266/199; 266/900

[58] Field of Search ..... 266/900, 901, 266/199, 183, 184; 432/95, 97, 239

[56] References Cited

U.S. PATENT DOCUMENTS

| | | | |
|---|---|---|---|
| 1,052 | 10/1838 | Van Dyke | 266/199 |
| 87,725 | 3/1869 | Swain | 266/901 |
| 202,730 | 4/1878 | Jones | 266/199 |
| 263,405 | 8/1882 | Hendrickson | 266/901 |
| 2,235,939 | 3/1941 | Maag | 266/901 |
| 2,264,423 | 12/1941 | Wingenroth | 266/199 |
| 3,633,897 | 1/1972 | Vogel | 266/199 |
| 3,753,688 | 8/1973 | Cherny et al. | 266/901 |
| 3,796,326 | 3/1974 | Buher | 266/901 |

*Primary Examiner*—Scott Kastler
*Attorney, Agent, or Firm*—Richard C. Conover

[57] ABSTRACT

An apparatus for charging a shaft-type cupola furnace and located between an upper stack and a lower furnace having a preselected inside diameter. An inverted conical trough is provided for receiving charge materials delivered to the furnace. The conical trough having an axis of rotation with an apex of the trough extending downwardly immediately above the furnace. The trough having an opening at its apex through which the charge materials may flow. The opening sized to have a diameter substantially the same as the inside diameter of the furnace. The trough positioned above the furnace with the opening positioned adjacent to and opening into the furnace. The apparatus further including means for rotating the conical trough about its axis of rotation. A circular charge door wall is provided with a bottom edge sized to abut against the inner surface of the conical trough above the opening. A lifting means for lifting the charge door to create a separation between the charge door and the conical trough to allow charge materials in the trough to flow into the furnace.

4 Claims, 4 Drawing Sheets

APPARATUS FOR CHARGING A SHAFT-TYPE CUPOLA FURNACE

This application claims benefit of provisional application 60/077,773 filed Mar. 11, 1998.

BACKGROUND OF INVENTION

Pollution control for foundry cupolas is a major problem. The open charge doors, used with conventional iron-melting cupolas, allow untreated gases to escape through the opening, contributing to the pollution problem. These charge doors are located on a side of an upper exhaust gas stack, and are used to introduce ferrous materials, coke, and limestone into the burden of the cupola. The open charge door allows the introduction of large amounts of ventilating air into the exhaust gases of the cupola which must be treated before release to the atmosphere. The pollution control equipment used to treat these exhaust gases must be large enough to accommodate this large amount of ventilating air.

Poor mixing of the incoming ventilating air with the exhaust gases also often causes intermittent small explosions known as "puffing". "Puffing" causes untreated gases to escape into the atmosphere through the open charging door. In addition, when conventional vibratory feeders are used to add charge materials through the open charge door of these conventional cupolas, the charge materials deflect part of the cupola exhaust gases outwardly through the open charge door. Untreated gases that escape through the open charge door are known as "fugitive emissions" because these gases bypass the pollution control equipment provided to treat the exhaust gases exiting the stack.

One method of solving the pollution problem associated with open charge doors is to use a feeding device which delivers the charge to the furnace through the charge door with apparatus for providing a positive air pressure outside the charge door. This positive pressure prevents the exhaust gases from exiting to the atmosphere through the charge door. U.S. Pat. No. 3,633,897 to Vogel illustrates this method.

Another source of pollution with conventional foundry cupolas is the melting process itself. With a vibratory feeder method of charging, the melting process is adversely affected as large, heavy pieces of incoming material tend to drop to a side of the cupola opposite the charge door, while small pieces tend to drop toward the side just below the charge door. A cupola burden formed in this way is detrimental to the efficient operation of the cupola. Process gases are diverted to a side of the cupola opposite the charge door since these gases pass more readily through the larger voids that exist between large pieces than through the smaller voids that exist between small pieces. In such a conventional cupola, a disproportionately large amount of the off-gases pass through the burden opposite the charge door, while a large proportion of the process heat is lost through the wall opposite the charging door.

What is needed is a device for introducing charging materials into a foundry cupola through a charge door without the need for providing positive air pressure outside the charge door. Further, a device is needed which promotes the complete combustion of combustible off-gases, and improves the thermal efficiency of the melting process to reduce the consumption of coke. What is needed is a device that distributes the incoming charge of ferrous materials, coke and limestone evenly around the periphery of the cupola, where the large pieces are deposited mainly in the center of the cupola, and the smaller pieces are deposited mainly toward the outside. This segregation of materials by size improves the thermal efficiency of the process by keeping the hot gases rising in the center of the burden, imparting more heat to the charging materials and reducing heat losses through the cupola wall. In addition, the device needs to restrict incoming ventilating air to a minimum and mix the necessary combustion air with the off-gases for complete and even combustion of combustible components.

SUMMARY OF INVENTION

This invention relates to apparatus for charging a shaft-type cupola furnace. The present invention includes charging apparatus which is located between an upper stack and a lower furnace having a preselected inside diameter. The apparatus includes a conveyor means for delivering charge materials to an inverted conical trough located above the furnace. The trough has an apex extending downwardly and further has an opening at the apex through which the charge material may flow. The opening is sized to have a diameter substantially the same as the inside diameter of the furnace. The trough is positioned above the furnace in surrounding relation with the upper stack, with the opening positioned adjacent to and opening into the furnace. The trough is rotatable about an axis of rotation and a motor is provided for rotating the conical trough about its axis of rotation. Further, a circular charge door wall is provided, sized to abut against an inner surface of the conical trough above the opening. Finally, a lifting means for lifting the charge door is provided to create a separation between the charge door and the conical trough to allow charge materials in the trough to flow into the furnace.

With this apparatus, the pollution problem associated with open charge doors is eliminated, because the charge door is open only a few seconds to allow the charge material to flow into the furnace. Further, with the present apparatus, large, heavy pieces of incoming charge material are deposited mainly in the center of the cupola, and the smaller pieces are deposited mainly toward the outside. This segregation of materials by size improves the thermal efficiency of the process by keeping the hot gases rising in the center of the burden, imparting more heat to the charging materials, and reducing heat loss through the cupola wall.

Further, a high pressure air plenum with injection nozzles opening into the furnace at a position immediately below the opening of the conical trough, is used to inject air into the furnace. This positioning of the injection nozzles allows for complete mixing of the necessary combustion air with the off-gases for complete and even combustion of combustible components.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
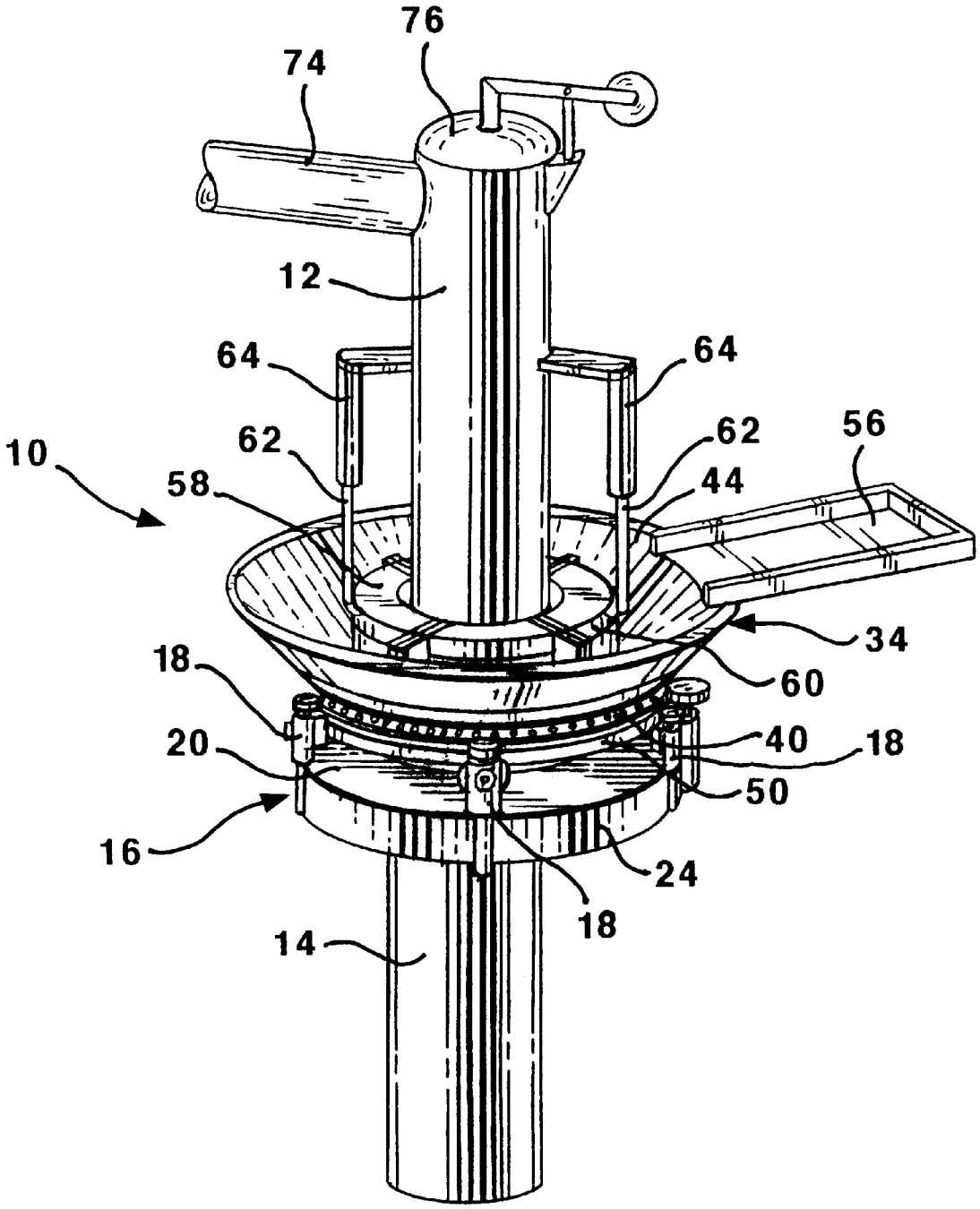
FIG. 1 is a perspective view of a cupola charging device according to the present invention.
Figure 2:
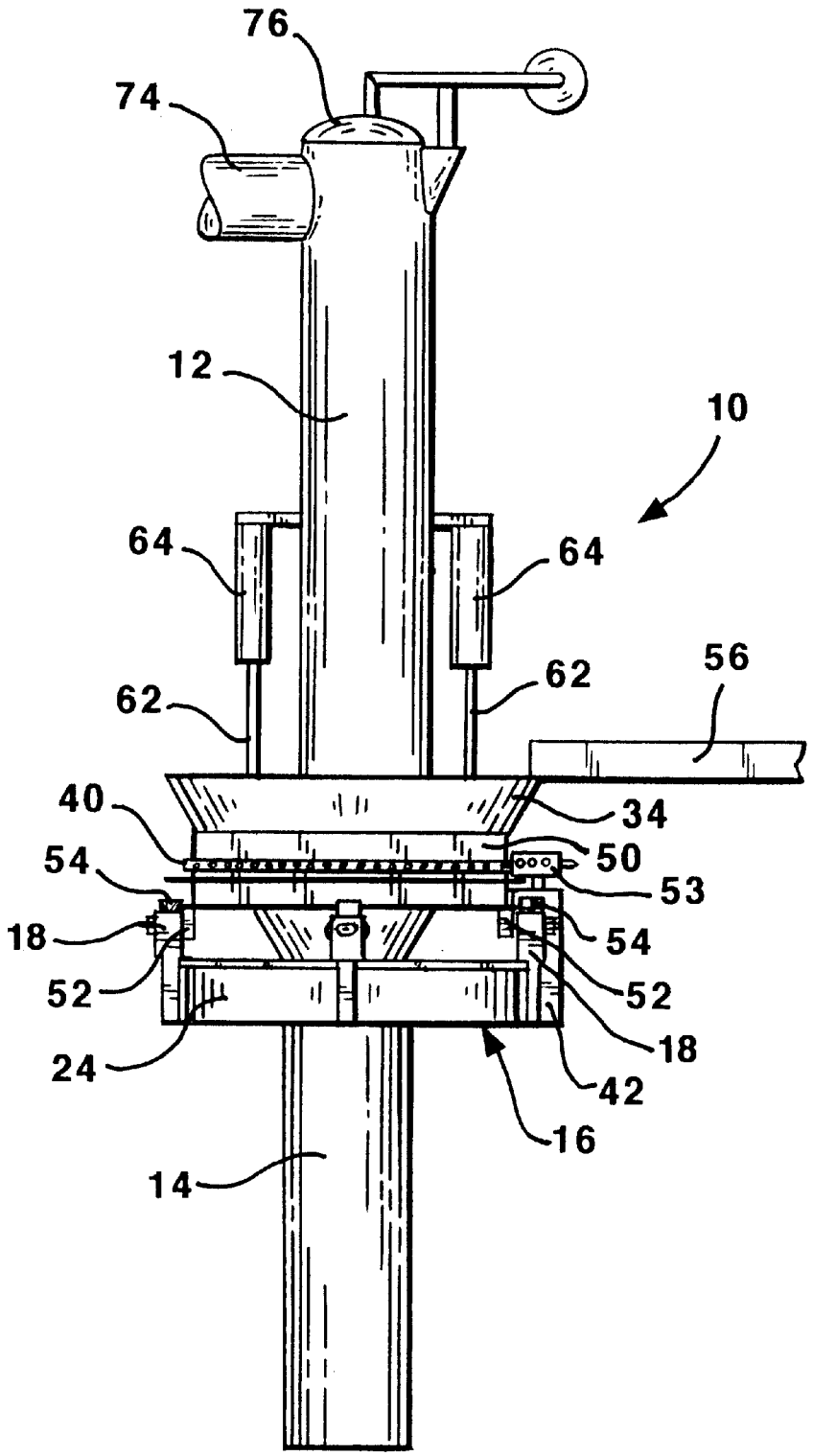
FIG. 2 is an elevational view of the cupola charging device shown in FIG. 1.
Figure 4:
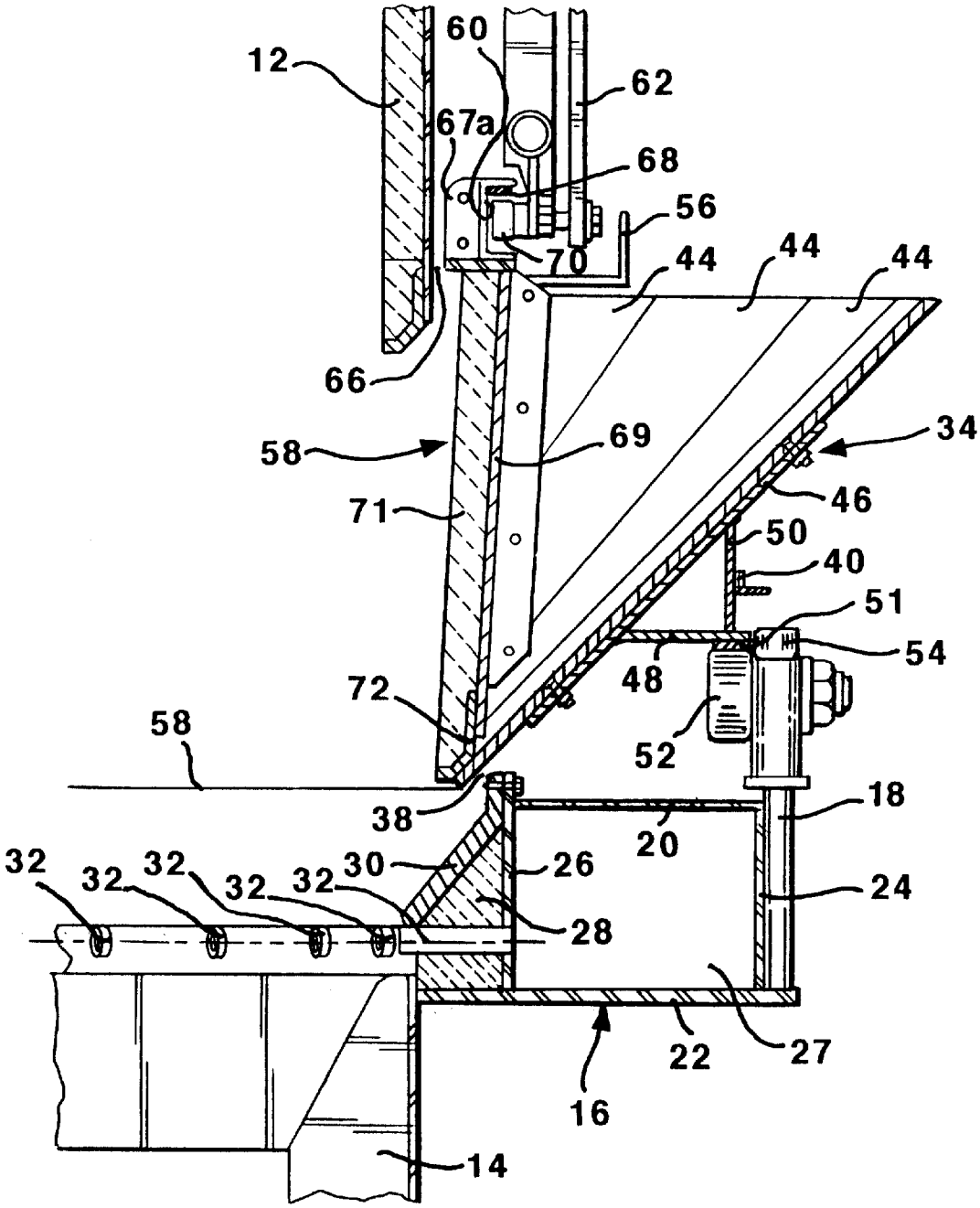
FIG. 4 is an enlarged, off-center view, partially in cross-section, of a cupola charging device taken along the line 4—4 in FIG. 3.

A cupola charging device 10 is shown in FIG. 1 and is positioned between an independently supported upper stack 12 (supports not shown) and a lower cupola furnace 14. The cupola charging device 10 includes an annular plenum chamber 16, as seen in FIGS. 1 and 4. Plenum chamber 16 includes an annular cover plate 20 spaced apart from a bottom annular plate 22. A circular outer wall 24 extends between cover plate 20 and bottom plate 22 on an outside radius, while circular inner wall 26 also extends between the cover and the lower plate at an inner radius. The bottom plate 22 is secured to cupola 14 as by welding. A refractory lining 28 is placed on the inside of inner wall 26 to protect the metal walls from the intense heat of an operable cupola. Heat resisting sloping segments 30 are also attached to inner wall 26 so as to overlay and protect refractory lining 28 against abrasive wear.

A series of evenly spaced injection nozzles 32 are provided to extend through inner wall 26 and refractory lining 28, as shown in FIG. 4, into cupola 14. An outside source of pressurized air (not shown) is conventionally connected to chamber 27 of plenum 16. This pressurized air is injected into cupola 14 through nozzles 32 to create turbulence for intimate mixing with the cupola off-gases. This is necessary for even and complete combustion of combustible components in the off-gases.

As seen in FIGS. 1 and 4, upright roller support posts 18 are secured to outer wall 24 of plenum chamber 16 around the periphery of plenum chamber 16. Horizontal rollers 52 are mounted to posts 18 as with a bolt and nut, and vertical rollers 54 are also mounted to roller posts 18, as shown in FIG. 4.

As seen in FIGS. 1 and 4, a rotating trough 34, which rides on rollers 52, is centered over cupola 14. Rotating trough 34 is constructed of segmented steel plates 44, which are angled approximately 45 degrees to the center line of the cupola to form an approximately conical surface opening upward. The plates 44 are sized to provide a hole at the conical apex which is directly over the cupola 14. The cupola furnace 14 has a preselected inside diameter, and the opening of the conical trough 34 is sized to be substantially the same as the inside diameter of the cupola 14. Steel plates 44 are held in place by being attached to a 360 degree conical section 46, as shown in FIG. 4. Conical section 46 is reinforced with an annular disk 48 which extends in a generally horizontal direction, and a circular wall 50 which extends in a generally vertical direction, as shown in FIG. 4. Disk 48 and wall 50 are secured to one another in a substantially perpendicular relation. The free ends of disk 48 and wall 50 are then secured to conical section 46 as by welding.

A roller plate 51 is secured as by welding to the lower side of annular disk 48. Roller plate 51 is positioned to rest on rollers 52. The rollers 52 are positioned to support trough 34 above the plenum chamber 16 sufficiently to provide an air gap 38 between trough 34 and plenum 16. Air gap 38 allows rotating trough 34 to turn freely above plenum chamber 16. The vertical rollers 54 are positioned to engage an end of disk 48 so as to keep rotating trough 34 centered over cupola 14.

To rotate the trough 34, a drive chain 40 is wrapped around circular wall 50, and is fixedly secured thereto as by welding. A sprocket 53 is turned by drive motor 42. Sprocket 53 engages chain 40, so that when drive motor 42 is powered on, trough 34 will revolve above cupola 14. It is readily evident that other methods of rotating trough 34, such as the use of a ring gear and pinion or drive friction rollers, well known in the art, could be used equally as well as the one described herein.

Charging materials moving to the cupola on a conventional vibrating feeder 56, are fed into rotating trough 34. These charging materials then slide down segmented steel plates 44 toward the bottom of the conical rotating trough. A circular charging door 58, as shown in FIGS. 1 and 4, is provided, which rests on the inner edges of segmented plates 44, above the opening of trough 34, blocking further movement of the charging materials into the cupola.

Figure 3:
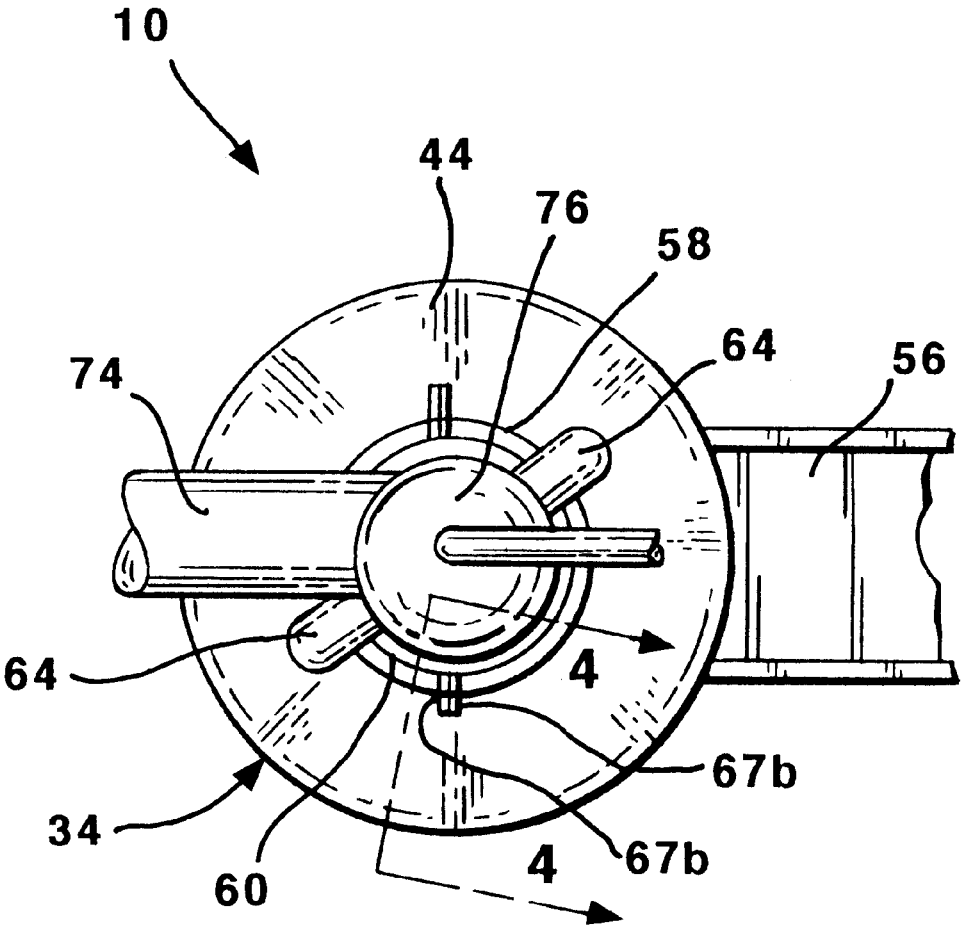
FIG. 3 is a plan view of the cupola charging device shown in FIG. 2.

As best seen in FIGS. 1 and 3, circular charging door 58 is constructed of four quarter-circle segments 69 that are bolted together to form a circular charging door. As best seen in FIG. 4, the quarter-circle segments 69 are bolted together with bolting flanges 67*a* secured to the top of each segment, and by side bolting flanges 67*b*, located on the sides of each quarter-circle segment, as shown in FIG. 4. A refractory lining 71 is provided on the inner side of the quarter-circle segments 69 to protect the metal of the charging door from the high temperatures of the cupola. Adjacent the bottom of segments 69, a cast iron segment 72 is attached to the inner interior side of segment 69 to support refractory lining 71, as shown in FIG. 4. The outer side of cast iron segment 72 abuts against plates 44 of rotating trough 34.

A circular "U" channel 60 is welded to the upper bolting flanges 67*a*, as shown in FIG. 4, which provides a race for rollers 70 secured to lifting arms 62, as shown in FIG. 4. With the charging door 58 closed, that is with segment 72 in frictional engagement with segments 44 of trough 34, the charging door 58 will revolve with trough 34. Charging door 58 will revolve on rollers 60 attached to lifting arm 62, so that the circular charging door can rotate while the lifting arms remain stationary. A circular wear strip 68 provides a wear resistant surface for roller 70 to roll against while the circular charging door 58 is revolving with trough 34. The circular charging door 58 is dimensioned to have a diameter greater than the diameter of the stack 12, so that an air gap 66 exists between charging door 58 and stack 12.

As best seen in FIG. 1, lifting arms 62 are connected to actuating cylinders 64. When these cylinders 64 are actuated, lifting arms 62 are retracted. Actuating cylinders 64 are fixedly attached to the stack 12. As can be appreciated, the lifting arms 62 may be connected to a hydraulic, pneumatic, or other electrically operated cylinder to retract arms 62. It can also be appreciated by those skilled in the art, that an externally operated yoke could be used as well in place of lifting arms 62 to lift charging door 58. When lifting arms 62 are retracted, the charging door 58 is moved upwardly by rollers 70 lifting channel 60.

When it is desired to permit charging materials to enter the cupola, lifting arms 62 are lifted to lift charging door 58. Material previously received in rotating trough 34 then slides down the sloping surface, underneath cast iron segment 72, at the bottom of the charging door 58, and into the cupola. When charging has been completed, lifting arms 62 are then dropped, allowing segment 72 to abut against segments 44 of rotating trough 34 to close the charging opening.

At the top of stack 12, closure 76 is used with counterweights to seal off the very top of the cupola as seen in FIG. 1. Conventional pollution control ducting 74 leads off-gases from the cupola to other conventional pollution control equipment (not shown) that is used to filter, scrub, or otherwise conventionally process the off-gases exiting a cupola. A volumetric capacity of the pollution control facility is sufficient to create a negative pressure to draw ventilating air into the cupola. Air enters the cupola through first air gap 38 and air gap 66 continually, and through the gap between segment 72 and segment 44 when the charge door 58 is opened. Air gap 38 also provides a path for the air being drawn into the cupola to strike both the ends of segmented plates 44 and sloping segments 30 of plenum chamber 16 to cool their parts. The negative air pressure prevents the escape of cupola off-gases through gap 38. Air being drawn into the cupola through air gap 66 also prevents the escape of cupola off-gases through this gap. Air flowing through air gap 66 provides cooling for adjacent metal parts.

In operation, trough 34 is rotated by chain 40 being turned by chain motor 42. Circular charging door 58 is closed, frictionally resting on rotating trough 34, and turns with the rotating trough. Then charging materials, such as coke, limestone and ferrous materials, are introduced to rotating trough 34, over the top of the trough, by a conventional vibrating feeder 56. This gradual dropping of charged materials onto rotating trough 34 evenly spreads each component of these charged materials around the circumference of the rotating trough. After all of the charging materials necessary for one charging cycle have been deposited onto rotating trough 34, the rotating movement is stopped by deactivating motor 42. When it is time to introduce the charge into the cupola, cylinders 64 are actuated so that the lifting arms 62 with rollers 70 can lift charging door 58. The charging materials slide down steel plates 44 underneath segment 72 of charging door 58, and onto sloping segment 30 into cupola 14. Small pieces, evenly distributed in rotating trough 34, will naturally fall at or near the outer periphery of the cupola, while the larger pieces, again evenly distributed in rotating trough 34, will naturally tumble toward the center of the cupola. This distribution of the materials over the horizontal cross-section of the cupola will cause the process gases to pass through the center of the burden, rather than along the side walls or outer periphery of the cupola. More of the available heat is imparted to the charging materials and less to the outer wall of the cupola, consequently improving the thermal efficiency of the melting process and reducing the amount of coke required for melting ferrous materials. The top of the burden will always remain below the bottom of plenum 16, since the rotating trough 34 is sized to accept only sufficient charging material to have this result. Since the top of the burden is below the bottom of plenum 16, an open space is provided where air injected through the nozzles 32 is mixed with the off-gases ascending from the burden. Since the injection nozzles are evenly spaced around the cupola, intimate and even mixing will be obtained for ready ignition of the combustibles in the off-gases. Ignition is generally accomplished by one or more conventional after-burners (not shown) located in the upper stack 12.

This improved mixing of combustion air with the cupola off-gases will provide stable, continuous burning, eliminating the small explosions or "puffing" at the charge door. Circular charging door 58 remains open only for a few seconds, and of sufficient duration, to allowing charging materials to slide into the cupola. This reduces the volumetric load on the pollution control equipment, compared with a cupola with an open conventional charging door. In addition, cupola gases cannot escape through the charge door opening because the pollution control equipment provides sufficient negative pressure to prevent cupola gases from exiting the openings open to the atmosphere.

While the fundamental novel features of the invention have been shown and described, it should be understood that various substitutions, modifications, and variations may be made by those skilled in the art without departing from the spirit or scope of the invention. Accordingly, all such modifications or variations are included in the scope of the invention as described by the following claims.

I claim:

1. Apparatus for charging a cupola foundry furnace having an upper stack and a lower furnace cupola having a preselected inside diameter comprising:

a conveyor means for delivering charge materials to the furnace;

an inverted conical trough, having an axis of rotation, for receiving the charge materials, the trough having an apex extending downwardly and further having an opening at the apex through which the charge material may flow, the opening sized to have a diameter substantially the same as the inside diameter of the furnace;

the trough positioned above the furnace and in surrounding relation with the upper stack, with the opening positioned adjacent to and opening into the furnace;

means for rotating the conical trough about its axis of rotation;

a circular charge door wall with a bottom edge sized to abut against an inner surface of the conical trough above the opening; and lifting means for lifting the charge door to create a separation between the charge door and the conical trough to allow charge materials in the trough to flow into the furnace.

2. The apparatus according to claim 1 wherein the trough is supported by rollers.

3. The apparatus according to claim 1 wherein the charge door has a race secured to a top edge of the charge door, the race comprising a "U" channel resting on its side and opening outwardly; and wherein the lifting means includes a lifting member having a roller provided at one end with the roller positioned to ride in the race and the lifting member further having a lifting device positioned at another end of the member for raising the lifting member, whereby the roller lifts the upper side of the "U"-shaped channel to raise the charge door.

4. The apparatus according to claim 1 further including a high pressure air plenum with injection nozzles opening into the furnace at a position immediately below the opening of the conical trough for injecting air into the furnace.

* * * * *